US005920260A

United States Patent [19]

Tseng

[11] Patent Number: 5,920,260

[45] Date of Patent: Jul. 6, 1999

[54] PURSE BURGLARPROOF STRUCTURE

[76] Inventor: Tien-Fu Tseng, No. 18, Cheng-Hsing East Street, Wu-Feng Hsiang, Taichung Hsien, Taiwan

[21] Appl. No.: 09/095,045

[22] Filed: Jun. 10, 1998

[51] Int. Cl.[6] ..... G08B 13/14

[52] U.S. Cl. ..... 340/571; 340/572.8; 340/568.7

[58] Field of Search ..... 340/571, 572, 340/573, 568, 574, 572.1, 572.8, 572.9, 573.7, 568.1, 568.2, 568.3, 568.4, 568.7

[56] References Cited

U.S. PATENT DOCUMENTS

| | | | |
|---|---|---|---|
| 3,701,140 | 10/1972 | Dixon | 340/571 |
| 3,815,118 | 6/1974 | McDonald | 340/571 |
| 4,633,232 | 12/1986 | Nelson et al. | 340/542 |
| 4,885,570 | 12/1989 | Chien | 340/571 |
| 5,408,220 | 4/1995 | Brown et al. | 340/571 |
| 5,510,768 | 4/1996 | Mann | 340/571 |
| 5,748,089 | 5/1998 | Sizemore | 340/574 |

*Primary Examiner*—Daniel J. Wu
*Assistant Examiner*—Van T. Trieu
*Attorney, Agent, or Firm*—Rosenberg, Klein & Bilker

[57] ABSTRACT

A purse burglarproof structure installed on a purse. The purse is equipped with a sound emitter and having a strap for a user to carry or hang the purse on the shoulder. The strap is disposed with a male buckle and a female buckle which are locked with each other by a predetermined locking force. The male and female buckles are serially electrically connected to the sound emitter via conductive wires to form a circuit. The male and female buckles are locked with or unlocked from each other so as to control the opening/closing of the circuit. In the case that the strap suffers a pulling force greater than the predetermined locking force, the male and female buckles are separated from each other to power on the sound emitter to emit loud sound for help and protection of a user and the purse.

1 Claim, 4 Drawing Sheets

PURSE BURGLARPROOF STRUCTURE

BACKGROUND OF THE INVENTION

The present invention relates to a purse burglarproof structure in which a male and a female buckles are disposed on a strap of the purse. In the case that the strap is pulled by a robber and the male and female buckles are separated from each other, a sound emitter to emit loud sound for help and scaring the robber.

Robbery takes place more and more frequently nowadays. Especially, a lady is often the object of a robber. It often takes place that a robber robs the handbag or purse carried by a lady. In order to protect the lady from robbery, a portable alarm (not shown) has been developed to be carried by a user for ensuring the safety of the user. However, such alarm can only protect the user, while failing to make the robber give up the robbed purse. Therefore, there will be still loss of properties.

SUMMARY OF THE INVENTION

It is therefore a primary object of the present invention to provide a purse burglarproof structure installed on a purse. The purse is equipped with a sound emitter and having a strap for a user to carry or hang the purse on the shoulder. The strap is disposed with a male buckle and a female buckle which are locked with each other by a predetermined locking force. The male and female buckles are serially electrically connected to the sound emitter via conductive wires to form a circuit. The male and female buckles are locked with or unlocked from each other so as to control the opening/closing of the circuit. In the case that the strap suffers a pulling force greater than the predetermined locking force, the male and female buckles are separated from each other to power on the sound emitter to emit loud sound for help so as to make the robber give up the robbed purse.

The present invention can be best understood through the following description and accompanying drawings, wherein:

DETAILED DESCRIPTION OF THE PREFERRED EMBODIMENTS

Figure 1:
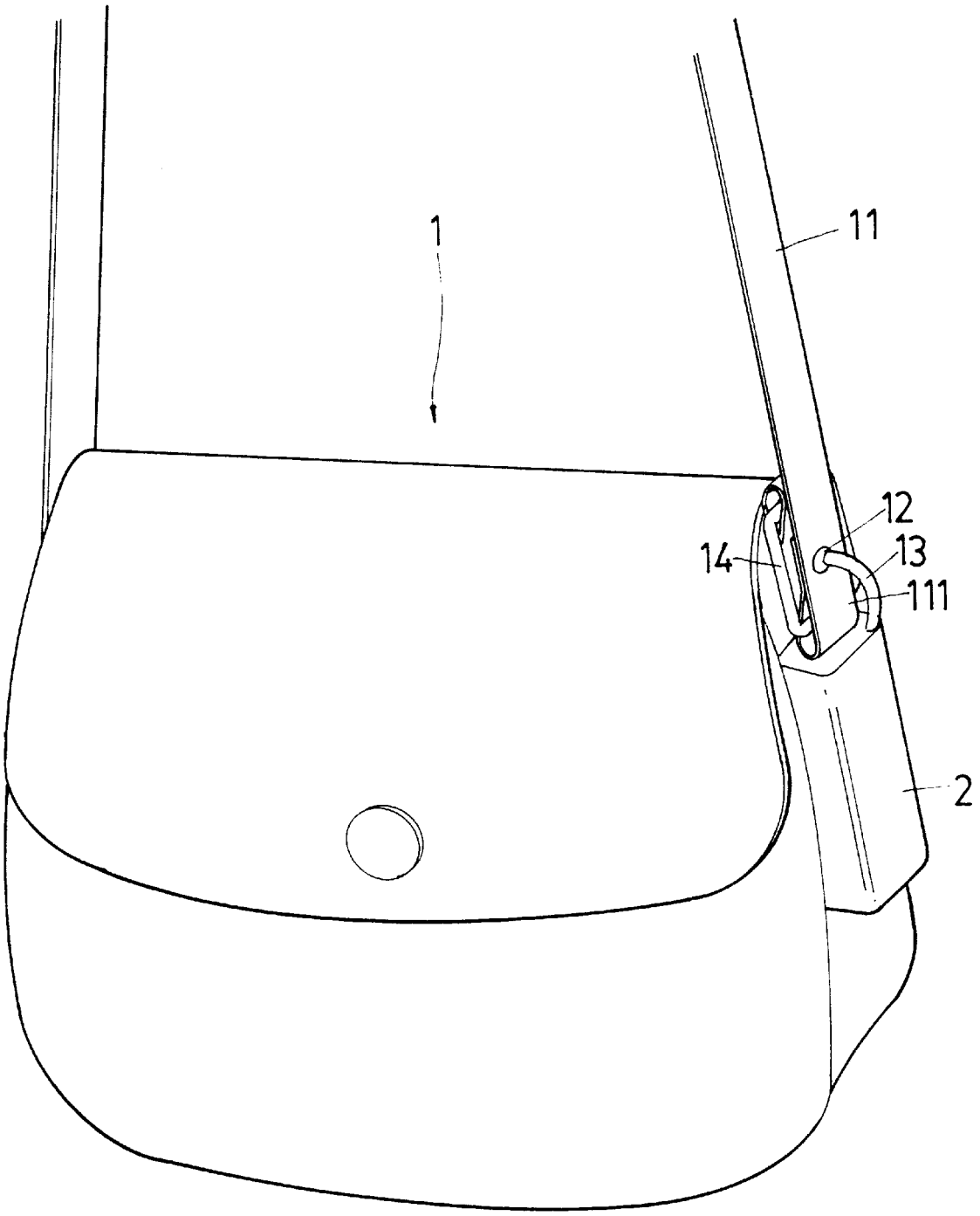
FIG. 1 is a perspective view of a first embodiment of the present invention.
Figure 2:
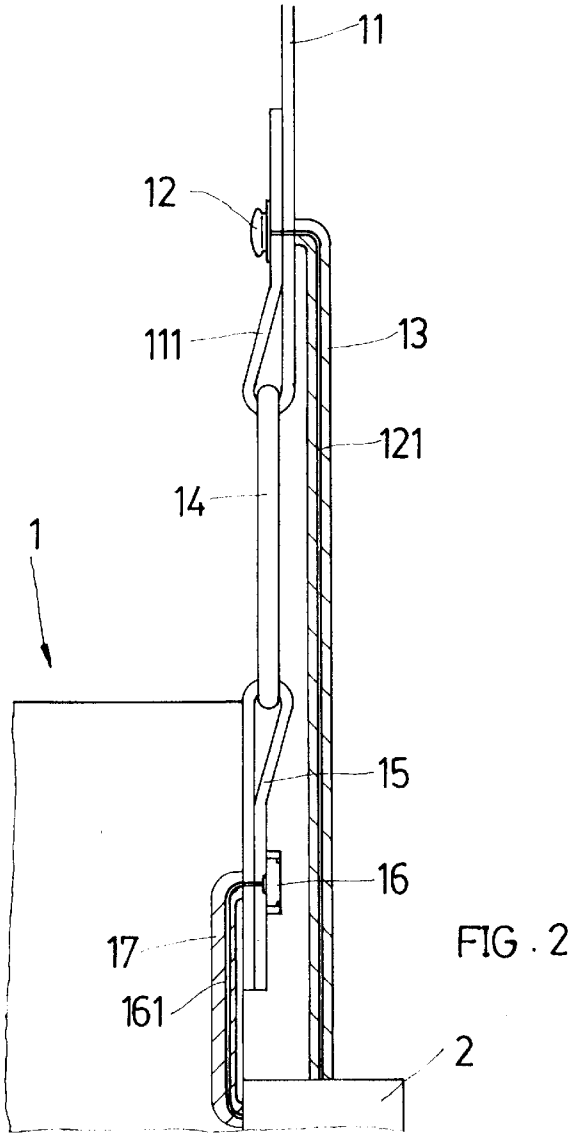
FIG. 2 is a side view of the first embodiment in a pulled apart state.

Please refer to FIGS. 1 and 2. The present invention is installed on a purse 1. The purse 1 has a strap 11 for a user to carry or hang the purse 1 on the shoulder. The strap 11 has a folding section 111. The inner side of the folding section 111 is disposed with a male buckle 12 made of electric conductive metal material. The male buckle 12 is connected with a first tube member 13 made of rigid material and receiving a first conductive wire 121 therein. The first conductive wire 121 is connected to a sound emitter 2 mounted on one side of the purse 1. The sound emitter 2 is able to emit loud sound. The folding section 111 is also connected with a ring body 14 at one end thereof. The other end of the ring body 14 is connected with a coupling section 15 disposed on the purse 1. The coupling section 15 is equipped with a female buckle 16 which can be locked with the male buckle 12 by a predetermined strength (8 kg in this embodiment). The female buckle 16 is connected with a second tube member 17 receiving a second conductive wire 161 therein. The second conductive wire 161 is further connected to the sound emitter 2.

Please refer to FIG. 2. In use of the present invention, the female buckle 16 is locked with the male buckle 12, whereby a current can be conducted from the sound emitter 2 through the first conductive wire 121 and the second conductive wire 161 back into the sound emitter 2 and power on the sound emitter 2. An internal circuit (not shown) of the sound emitter 2 controls the sound emitter 2 not to emit sound. In case a lady carrying the purse 1 outdoors encounters a robber who drags the strap 11 with a strength greater than 8 kg, the male buckle 12 will be separated from the female buckle 16. This disconnects the first conductive wire 121 from the second conductive wire 161 and thus the current cannot be conducted back into the sound emitter 2. At this time, the controlling circuit in the sound emitter 2 controls the sound emitter 2 to emit loud sound for help. Therefore, although the robber takes away the purse 1, the sound emitter 2 in thepurse 1 will continuously emit the sound. In a nervous state, the robber can hardly find out how to shut off the sound emitter 2. Therefore, the loud sound will attract the attention of other people who may go to the police. Accordingly, the robber will leave the purse 1. As a result, the safety of the lady and the purse 1 can be ensured.

Figure 3:
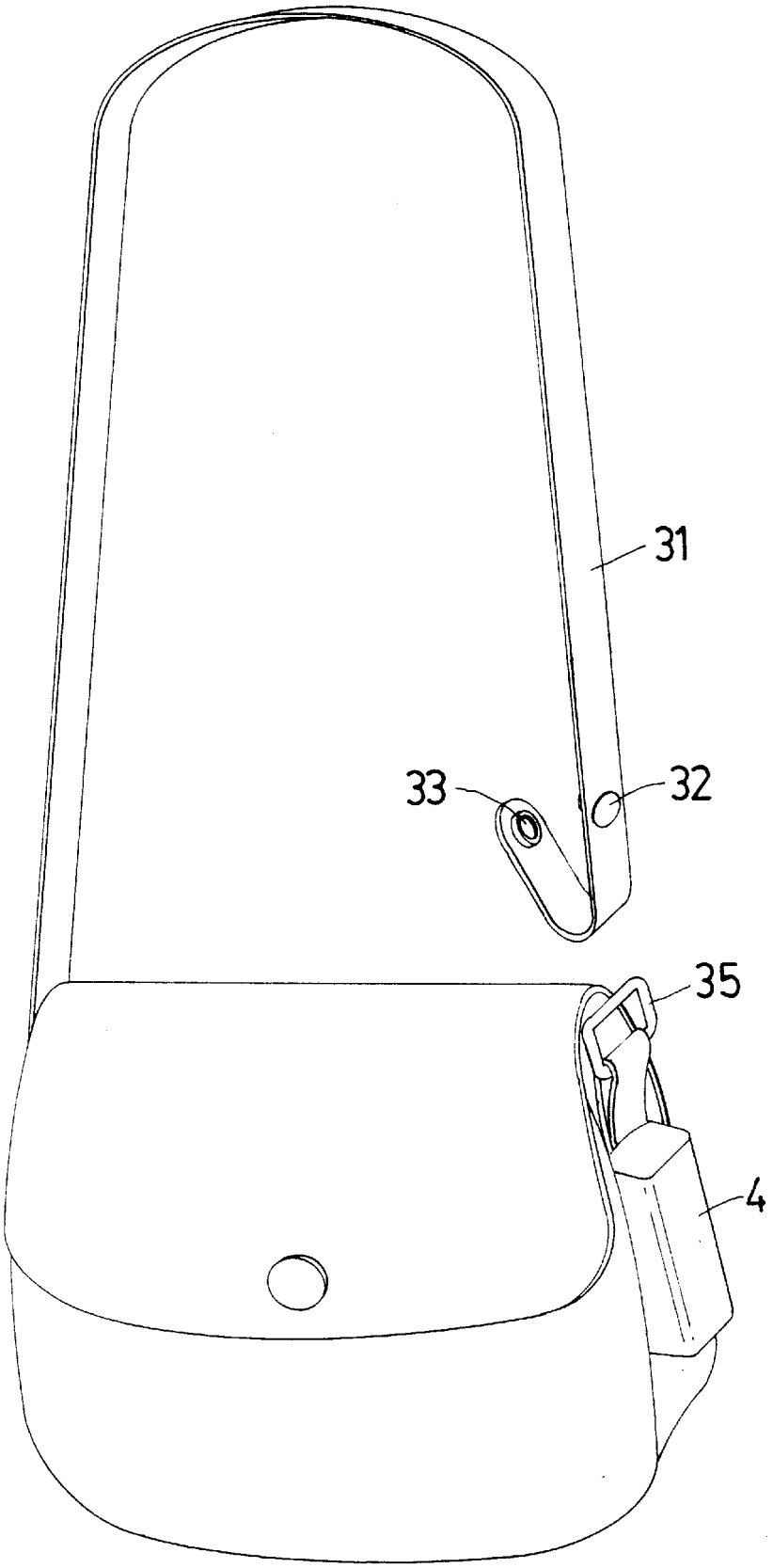
FIG. 3 is a perspective view of a second embodiment of the present invention.
Figure 4:
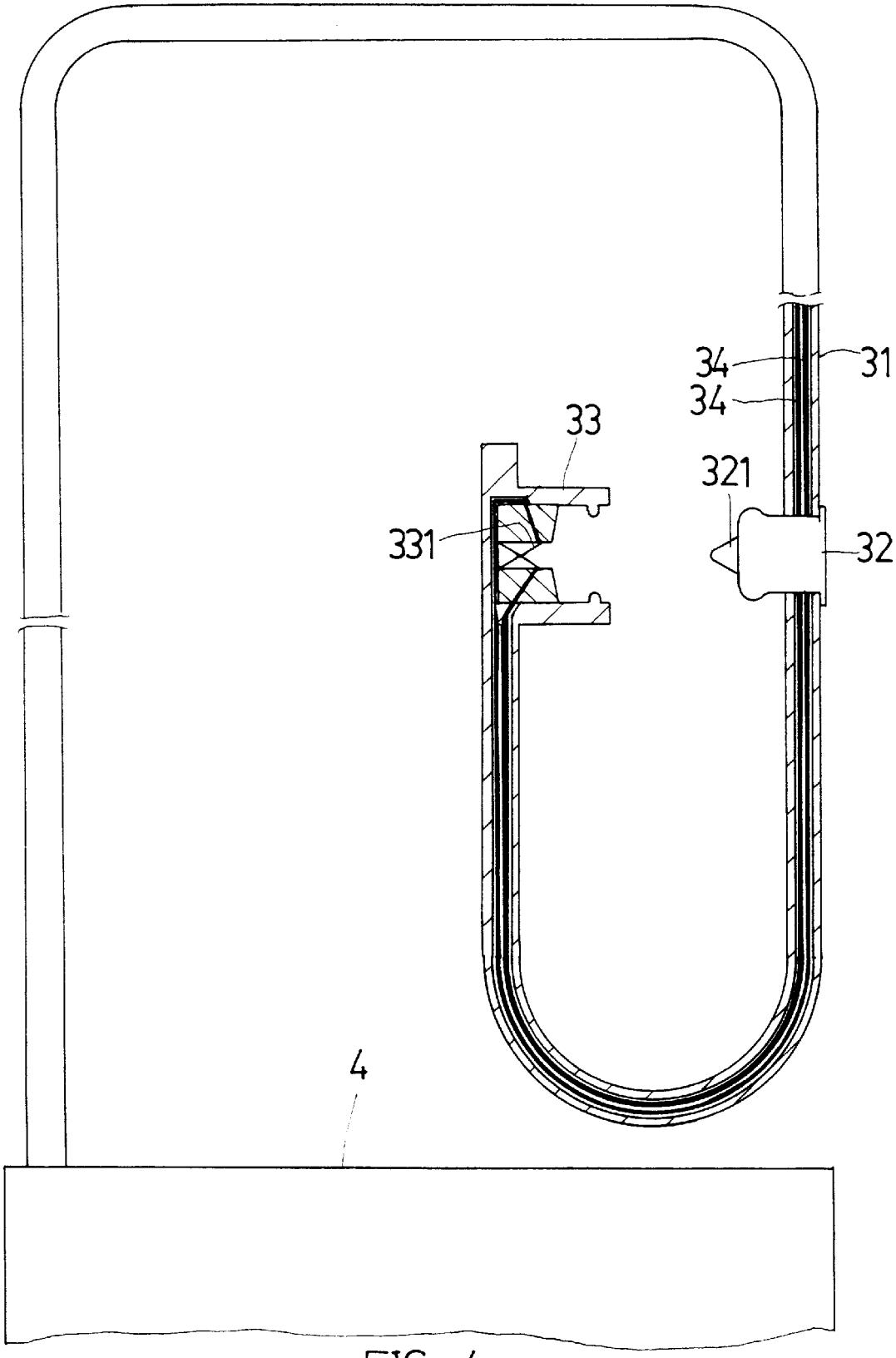
FIG. 4 is a sectional view of the second embodiment, showing the male and female buckles thereof.

FIGS. 3 and 4 show a second embodiment of the present invention, in which a male buckle 32 is disposed at a predetermined position near the end of the strap 31. The male buckle 32 has a projection 321made of insulative plastic material. In addition, a female buckle 33 is disposed at the end of the strap 31. The female buckle 33 has two resilient plates 331 disposed therein for contacting with each other. Each resilient plate 331 is connected with a conductive wire 34 wrapped in the strap 31 and connected to the sound emitter 4. One conductive wire 34 serves to conduct the current out of the sound emitter 4, while the other serves to conduct the current back into the sound emitter 4. The end of the strap 31 is folded to surround the ring body 35 with the male buckle 32 plugged into the female buckle 33. At this time, the projection 321 of the male buckle 32 makes the two resilient plates 331 in the female buckle 33 separate from each other to disconnect the conductive wires 34. Therefore, the sound emitter 4 is unable to emit sound. In case the strap 31 is pulled by a robber and the male buckle 32 is detached from the female buckle 33, the two resilient plates 331 are permitted to contact with each other and electrically connect the two conductive wires 34. At this time, the sound emitter 4 is powered on to emit loud sound for scaring the robber.

Figure 5:
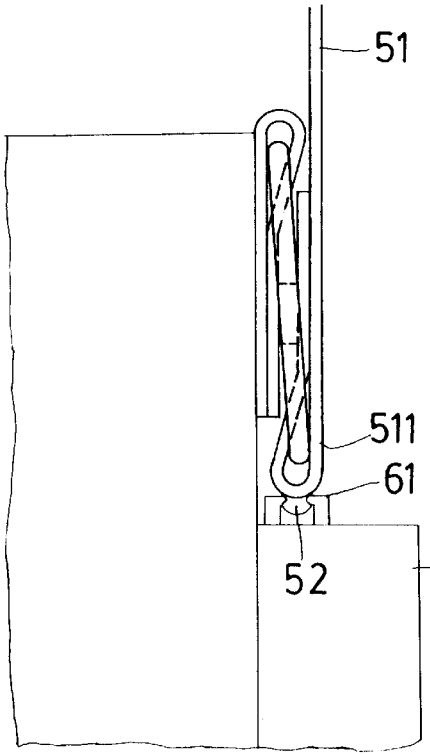
FIG. 5 is a side view of a third embodiment of the present invention.

FIG. 5 shows a third embodiment of the present invention, in which the male buckle 52 is disposed at the folding section 511 of the strap 51 and the female buckle 61 is disposed on the sound emitter 6 for locking with the male buckle 52. In case a robber pulls the strap 51, the female buckle 61 is separated from the male buckle 52, enabling the sound emitter 6 to emit loud sound for scaring the robber.

It is to be understood that the above description and drawings are only used for illustrating some embodiments of the present invention, not intended to limit the scope thereof. Any variation and derivation from the above description and drawings should be included in the scope of the present invention.

What is claimed is:

1. A purse burglarproof structure installed on a purse, comprising:

a sound emitter coupled to the purse;

a shoulder strap for supporting the purse from a user's body, said shoulder strap having (a) a coupling section secured to the purse, (b) a female buckle secured to said coupling section and formed of an electrically conductive material, (c) a folding section, (d) a male buckle mounted on an inner side of said folding section and formed of an electrically conductive material, said male buckle being coupled to said female buckle and being separable therefrom responsive to a predetermined pulling force applied to said shoulder strap, and (e) a ring body pivotally joining said folding section to said coupling section;

a first tube member extending between said sound emitter and said male buckle, said first tube member being formed of a rigid material;

a first conductive wire disposed in said first tube member and electrically coupling said male buckle to said sound emitter;

a second tube member extending between said sound emitter and said female buckle; and, a second conductive wire disposed in said second tube member and electrically coupling said female buckle to said sound emitter for electrically coupling said first conductive wire to said second conductive wire when said male buckle is coupled to said female buckle and forming an open circuit when said male buckle is separated from said female buckle, said sound emitter emitting sound responsive to formation of said open circuit.

* * * * *